US006117305A

United States Patent [19]

Bando et al.

[11] Patent Number: 6,117,305

[45] Date of Patent: Sep. 12, 2000

[54] METHOD OF PRODUCING WATER SLURRY OF SDA ASPHALTENE

[75] Inventors: Shoichi Bando; Takao Takinami, both of Handa; Makoto Inomata, Yokohama, all of Japan

[73] Assignee: JGC Corporation, Tokyo, Japan

[21] Appl. No.: 08/889,965

[22] Filed: Jul. 10, 1997

[30] Foreign Application Priority Data

| | | | |
|---|---|---|---|
| Jul. 12, 1996 | [JP] | Japan | 8-183764 |
| Sep. 27, 1996 | [JP] | Japan | 8-256029 |
| Nov. 18, 1996 | [JP] | Japan | 8-306888 |

[51] Int. Cl.[7] ..... C10C 1/00

[52] U.S. Cl. ..... 208/39; 208/45; 208/13; 208/14; 44/280; 44/313

[58] Field of Search ..... 208/45, 13, 14; 44/280, 39

[56] References Cited

U.S. PATENT DOCUMENTS

| | | | |
|---|---|---|---|
| 4,537,600 | 8/1985 | Tijima et al. | 44/51 |
| 4,539,012 | 9/1985 | Ohzeki et al. | 44/51 |
| 4,565,546 | 1/1986 | Ohzeki et al. | 44/51 |
| 4,624,807 | 11/1986 | Mijauchi et al. | 44/1 F |
| 5,059,300 | 10/1991 | McGinnis | 208/44 |
| 5,478,365 | 12/1995 | Nikanjam et al. | 44/280 |

*Primary Examiner*—Helane Myers
*Attorney, Agent, or Firm*—Kubovcik & Kubovcik

[57] ABSTRACT

Disclosed is a method of producing water slurry of SDA asphaltene by dispersing residue resulting from solvent deasphalting of petroleum vacuum residue produced in refineries, which has low viscosity even at a high solid concentration and is stable for a long period of time, in industrial scale under stable operation. The method comprises a grinding step of grinding the SDA asphaltene with water in a grinding apparatus in the presence of a dispersing agent, followed by a stabilizing step of stirring the resulting slurry to stabilize it. In the grinding step a suitable amount of a thickener such as carboxymethyl cellulose is added. Grinding is preferably carried out at a temperature not higher than 80° C. Jacketed ball mills are conveniently used. In the stabilizing step a stabilizer such as Attapulgus clay is added after stirring the slurry to decrease viscosity thereof and stirring is continued.

10 Claims, 1 Drawing Sheet

METHOD OF PRODUCING WATER SLURRY OF SDA ASPHALTENE

BACKGROUND OF THE INVENTION

1. Field in the Industry

The present invention concerns a method of producing water slurry of Solvent-DeAsphalting (hereinafter abbreviated to "SDA") asphaltene. The "SDA asphaltenes" are obtained as residues of solvent-deasphalting of petroleum residues such as atmospheric residue, vacuum residues, residue from tar sand bitumen, shale oil, and coal liquefaction residues, using a light hydrocarbon solvent to extract oily substances from these sources. The SDA asphaltenes are dispersed in an aqueous solution of a surface active agent (hereinafter referred to as "surfactant") in accordance with the method of this invention to form a slurry of high solid concentration.

2. Prior Art

Conventional utilization of petroleum resources has been, from the view points of convenience in handling such as transportation and storage, mainly of gaseous fuels and liquid fuels, and utilization of residual substances has been limited to heavy fuel oil with cutter stocks such as gas oil and FCC light cycle oil and materials for road construction or so. However, because reserves of petroleum are decreasing and the crude petroleum are getting heavier, it has been demanded to develop ways to completely utilize the residual components as energy source.

The residual oils are upgraded into light products by a resid-hydrocracking and resid-fluid catalytic cracking. The bottoms from these processes are used as a heavy fuel oil or further processed to be converted into a valuable fuel oil. In general, these processes are more expensive and the residual oils as feedstocks are limited by contents of metals and asphaltenes because they may cause damage to catalysts. A thermal cracking and a solvent deasphalting processes can upgrade very heavy residual oils regardless of contents of metals and asphaltenes thereof, and are relatively inexpensive. However, cokes and asphaltenes are produced as by products and utilized as solid fuels, liquid fuels with cutter stock and asphalt cement.

Needless to say, liquid fuels are advantageous to solid fuels in handling such as transportation, storage and combustion, and therefore, it is desirable to use the SDA asphaltenes in the form of a liquid fuel. Conventionally, in case where it is intended to use the SDA asphaltene in the form of a liquid fuel, an emulsion is formed by adding LCO (light cycle oil) or light oil, which are valuable oils produced through SDA integrated with other process for upgrading of fuel oil. However, addition of such valuable liquid fuel oils to the residue lowers the economy as a whole of the refinery. From this point of view hope is placed on the water slurry prepared by grinding the SDA asphaltenes and dispersing the resulting particles in an aqueous surfactant solution.

As is well known, so-called CWM (Coal-Water Mixture) technology, in which coal powder with a proper particle size distribution is dispersed in water to form a slurry, has been practiced as the technology which enables handling coal, a solid fuel, in a similar way to handle liquid fuels. It has been, therefore, intended to apply this technology to utilize the SDA asphaltenes like a liquid fuel. However, there have been many problems concerning the SDA asphaltenes utilization because of difference in the chemical compositions and the physical shapes of particles from those of coal powder. They are: grindability and dispersibility in the process of slurry formation, limit of attainable concentration, low stability of the product slurry, and particularly, sensitivity to temperature changes, and resulting difficulties in handling of the water slurry. These problems may not be solved by the known CWM technology.

Japanese patent disclosure No. 62-225592 employs, for production of water slurry from petroleum-based high carbonaceous material such as pitch and asphalt, grinding step consisting of wet impact crushing and frictional grinding to aim at a high packing density and a low viscosity. Though this process facilitates control of particle sizes, two-step grinding requires high energy consumption, and therefore, the process is disadvantageous from the view point of costs.

Anyway, in order to utilize the petroleum-based high carbonaceous substances such as atmospheric residue and vacuum residue as a fuel source to the maximum extent, it is necessary to apply solvent deasphalting to these substances to extract oily fuel components to the limit and use the SDA asphaltene thus obtained by transforming it into a water slurry of high solid concentration and good stability.

With respect to the slurry concentration, as mentioned in the above Japanese patent disclosure No. 62-225592, it is considered that the theory of closest packing as discussed in regard to the CWM technology may also be applied. If it is desired to suppress viscosity of the slurry at 25° C. to be 1000 cps at highest because of convenience in handling, realizable concentration will be in the level of 70 wt. % or a little higher than that.

Of the processes for producing the water slurry of the SDA asphaltene the one-step grinding process, which comprises grinding coarsely crushed material in water in the presence of a dispersing agent seems to be the most practical and economical process. However, contrary to our expectation, difficulty was experienced, at production of the water slurry of SDA asphaltene, in forming a slurry having such a high concentration as 65–75 wt. %.

As the cause of this difficulty it can be discussed that there is a difference in chemical compositions, i.e., the SDA asphaltene contains much more volatile matter than coal and contents of heavy metals and sulfur are higher in the former than in the latter, and further, a difference in specific gravities, shapes of crushed coarse particles and grinding properties. Particularly, based on our experience, the SDA asphaltene can be easily ground with grinding energy smaller than that required for grinding coal and the resulting particle size distribution tends to be in relatively narrow ranges, and this may be the cause of difficulties in preparation of high concentration water slurry.

In fact, if grinding is interrupted in practical grinding operation, fluidity of the slurry significantly decreases and, in batchwise grinding, it will be difficult to even discharge the product slurry from the apparatus. Even in an apparatus for continuous operation process apparatus design must be complicated to keep the slurry fluid, and thus, slurry concentration cannot be so high.

Referring to a concrete example, we tried to transform an SDA asphaltene produced in a petroleum refinery from middle east crude oil by processing in water to a slurry having a viscosity up to 1000 cps at 25° C. using a ball mill-type grinder and an anion surfactant as the dispersing agent. At the initial stage of grinding there were a few small sized particles which fill gaps between large sized particles in the slurry, and therefore, the closest packing could not be attained and stability of the slurry was low. Thus, we continued grinding and as a result, learned that the grinding proceeded within the nearly same narrow ranges of particle sizes and in turn, that particles of larger sizes became minor and thus, the resulting particle size distribution was far from the closest packing. Tendency of the particle size distribution in our experiments is shown in Table 1 below:

TABLE 1

| Stage | Initial | Advanced |
|---|---|---|
| 10% | 2.66 μm | 1.44 μm |
| 50% | 15.84 | 6.39 |
| 90% | 66.19 | 28.02 |
| MV* | 26.16 | 11.05 |

*Mean diameter: of the Volume

It was concluded that the known technic to obtain a CWM of high solid concentration, i.e., combining a group of relatively small particles sizes and a group of relatively large particle sizes to establish a particle size distribution suitable for the closest packing, is difficult to realize even if applied to the SDA asphaltene slurry production. This is caused mainly by the fact that, when grinding is continued for the purpose of obtaining the group of relatively small particle sizes, particle size distribution shifts to the side of smaller sizes and, even in the presence of a dispersing agent, extraordinary decrease of fluidity occurs.

SUMMARY OF THE INVENTION

The object of the present invention is to solve the above discussed problems in the production of a slurry in which particles of SDA asphaltene are dispersed in an aqueous surfactant solution, and to provide a method of producing the slurry of SDA asphaltene having good stability at a high solid concentration without necessitating extremely large energy consumption and complicating the process.

The method of producing a water slurry of SDA asphaltene having good stability at a high solid concentration according to the present invention comprises a grinding step of grinding the SDA asphaltene with water in a grinding apparatus in the presence of a dispersing agent, and a stabilizing step of stirring the resulting slurry to stabilize it. The method is characterized by the fact that the grinding step is carried out with addition of a thickener as a viscosity increasing agent (hereinafter referred to simply as "thickener"), or the stabilizing step is carried out with addition of a stabilizer, or the grinding step is carried out with addition of a thickener and the stabilizing step is carried out with addition of a stabilizer.

BRIEF EXPLANATION OF THE DRAWINGS

The drawings show the data of working examples of the present invention; in which.

DETAILED EXPLANATION OF THE PREFERRED EMBODIMENTS

Figure 1:
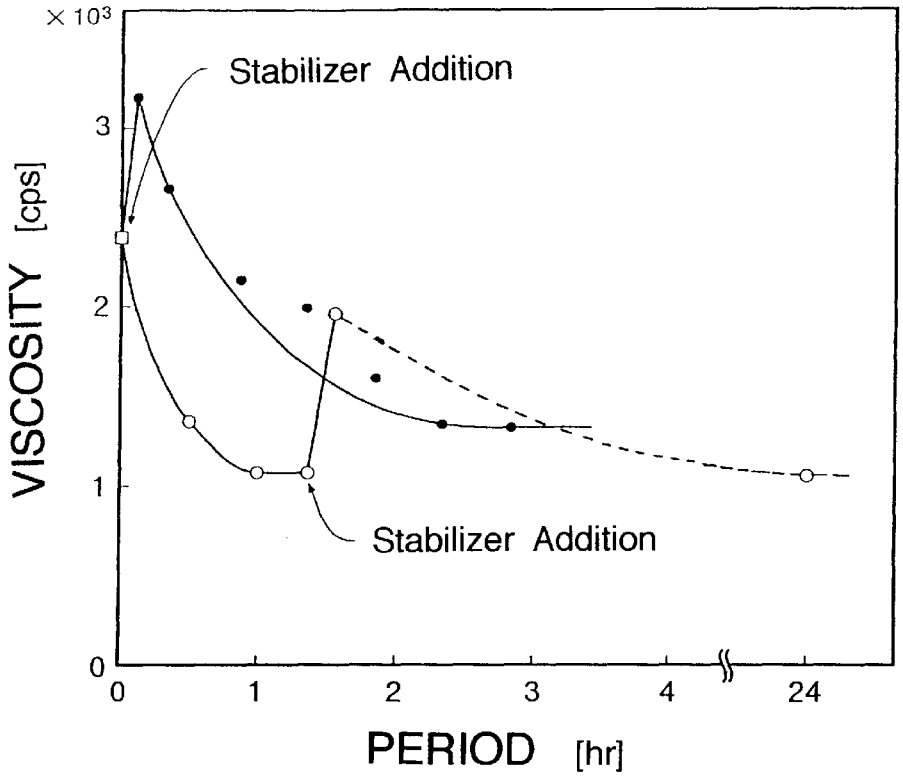
FIG. 1 is a graph showing changes in viscosity of water slurry at the stabilizing step of the claimed method with the data of a control example.

As the dispersing agent various surfactants may be used. Suitable anion surfactants are: ligninsulfonic acid salts, particularly, calcium, magnesium and sodium salts; partially desulfonated ligninsulfonic acid salt having sulfonyl or carboxyl group, phenolic hydroxyl group, or alcoholic hydroxyl group as a functional group; naphthalenesulfonic acid salts, particularly, sodium or magnesium salt; naphthalenesulfonic acid-formalin condensation products or their sodium or magnesium salt; and polystyrenesulfonic acid salt, particularly, sodium salt. Among them, naphthalenesulfonic acid-formalin condensation product or a salt thereof is the best dispersing agent in view of the fact that influence of temperature change on its effect is small, and it give no influence to the thinckeners, and thus it keeps the formed slurry stable.

Examples of useful nonionic surfactants are: polyoxyethylene octylphenyl ether, polyoxyethylene nonylphenyl ether, polyoxyethylene lauryl ether, polyoxyethylene cetyl ether, polyoxyethylene sorbitan monolaurate and polyoxyethylene sorbitan monopalmitate. Nonionic surfactants are, in general, capable of easy slurry formation at production of SDA asphaltene slurry due to their strong lipophilic property, while its tendency to foam and sensitivity to temperature change are pointed out as their drawbacks.

Amount of the dispersing agent to be used is 0.1–1.5 wt. %, preferably, 0.3–1.0 wt. %, based on SDA asphaltene.

As the thickener one or more of the substances chosen from the following groups may be used:

1) carboxymethyl cellulose (CMC), hydroxyethyl cellulose (HEC), xanthan gum, gua gum, starch, polyvinyl alcohol, polyethylene glycol and polyethylene oxide;
2) sodium hydroxide and potassium hydroxide; and
3) magnesium hydroxide, magnesium oxide, colloidal silica, kaolin and bentonite. Attapulgus clay (main component is colloidal silica) is also a member of this group.

Quantity of the thickener to be used should be so chosen that the concentration in the slurry will be 20–3000 ppm, preferably, 50–2000 ppm.

Grinding of the SDA asphaltene in the presence of a thickener facilitates slurry formation and at the same time enables production of stable slurry of a high solid concentration. Presence of the thickener brings about stabilizing effect and preferable particle size distribution. Grinding is performed until the particle size of SDA asphaltene becomes substantially 500 μm or less, preferably, 200 μm or less.

Stabilizing is conducted by stirring the slurry to the extent that the viscosity of the slurry is decreased to 1500 cps or less, preferably, to 1200 cps or less.

In a preferred embodiment of the present method the grinding step is carried out with addition of a thickener, and the stabilizing step is carried out with addition of a stabilizer.

As the stabilizer one or more of the substances chosen from the following groups are used:

a) carboxymethyl cellulose, hydroxyethyl cellulose, xanthan gum, gua gum, starch, polyvinyl alcohol, polyethylene glycol and polyethylene oxide; and
b) magnesium hydroxide, magnesium oxide, colloidal silica, kaolin, bentonite and Attapulgus clay.

Quantity of the stabilizer to be used should be so chosen that the concentration in the slurry will be 20–3000 ppm, preferably, 50–2000 ppm.

It is preferable that the ratio of the thickener added in the grinding step and the stabilizer added in the stabilizing step is in the range of, by weight, 1:7–2:1.

Preferable examples of combined use of the thickener and the stabilizer are as follows.

i) As both the thickener and the stabilizer an organic high polymer is used: in the grinding step CMC of 20–1000 ppm, preferably, 50–400 ppm based on the slurry is added and grinding is conducted, and then, in the stabilizing step CMC of further 50–500 ppm is added for viscosity regulation.

ii) As the thickener an organic high polymer is used and as the stabilizer an inorganic fine powdery substance is used: in the grinding step CMC of 20–1000 ppm, preferably, 50–400 ppm based on the system is added and grinding is conducted, and then, in the stabilizing step Attapulgus clay of 100–3000 ppm, preferably, 300–2000 ppm is added.

iii) As both the thickener and the stabilizer an inorganic fine powdery substance is used: in the grinding step Attapulgus clay of 100–3000 ppm, preferably, 100–2000 ppm based on the slurry is added and grinding is conducted, and then, in the stabilizing step Attapulgus clay of further 20–1000 ppm, preferably, 50–500 ppm is added.

Of the above three embodiments second one, which uses a hydrophilic organic high polymer in the grinding step and an inorganic fine powdery substance in the stabilizing step, is preferable.

In another preferable embodiment of this method producing water slurry of SDA asphaltene by grinding the SDA asphaltene with water in a grinding apparatus in the presence of a dispersing agent to form a water slurry, the grinding is carried out at a slurry concentration in the range of 65–75%, preferably, 67–71 wt. %, more preferably, 68–70 wt. %, and at a temperature up to 80° C. In case where the concentration of the SDA asphaltene in the slurry is lower than 65 wt. %, economy of the slurry is low. On the other hand, if such a high concentration as 75 wt. % or higher is intended, then, slurry production will be difficult. Suitable temperature at grinding will be, depending on the properties of the SDA asphaltene, kind of dispersing agent used and targeted slurry concentration, in the range from ambient temperature to 80° C. In case of relatively high grinding temperature, say, 70–80° C., in order to control concentration of the product slurry to a desired level it is necessary to decide formulation of the materials supplied to a ball mill taking account the quantity of water to be lost by evaporation.

In practice of the above mentioned basic embodiment of the present method we experienced a phenomenon that addition of the stabilizer at the stabilizing step may cause sometimes significant increase in viscosity of the slurry and that, even stirring is continued, decrease of the viscosity saturates at a certain limit and lowering to a desired level of the viscosity cannot be realized. Also we learned by experienced that, in such a case as note above, effect of stabilizing the slurry is sometimes not so high as expected. To cope with this, the present method, in a still other preferable embodiment, addition of the stabilizer at the stabilizing step is carried out after stirring the slurry formed by the grinding step to decrease the viscosity thereof.

Usually, the slurry formed in the grinding step has a viscosity of about 2500 cps. Stirring this slurry causes gradual decrease in the viscosity. It is advantageous to conduct addition of the stabilizer at the point of time where the viscosity is decreased to 1500 cps or less, preferably, to 1200–600 cps. If the stabilizer is added while the viscosity is still higher than 1500 cps, adjustment of viscosity of the slurry will take long time, and further, yielding point (TAU value) as the measure of the stability will not be to a desired level. On the other hand, if it is intended to add the stabilizer after too much decrease of the viscosity, significant stirring energy and long period of time will be necessary. This will be of course disadvantageous for operation.

Figure 2:
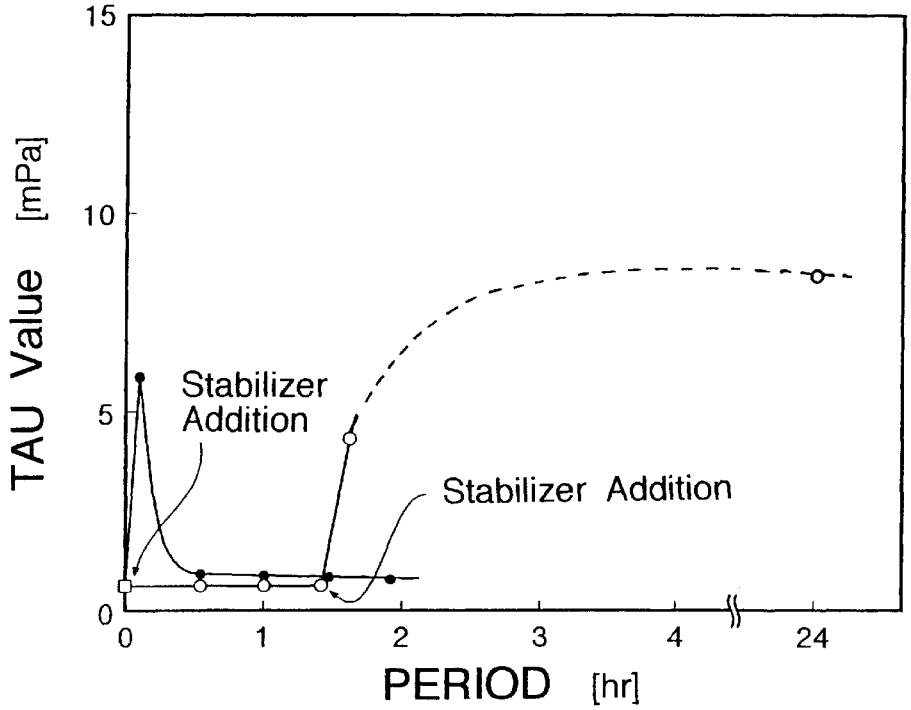
FIG. 2 is a graph showing changes in yielding point (TAU value) of water slurry also at the stabilizing step of the claimed method with the data of the control example.

The effect of delayed addition of the stabilizer employed by the present invention, i.e., when the grinding step is finished and the stabilizing step is begun, the stabilizer is added not immediately but after stirring the water slurry to decrease the viscosity, is shown in the graphs of FIG. 1 and FIG. 2. FIG. 1 and FIG. 2 illustrate observed time change of the viscosity as a measure of fluidity and yielding point (TAU value) as a measure of stability of the slurry (concentration about 70 wt. %) obtained by grinding an SDA asphaltene in water in the presence of a dispersing agent, which were divided into two portions and each portions were subjected to (1) immediate addition of Attapulgus clay of 2000 ppm as the stabilizer and continued stirring, or (2) delayed addition of the stabilizer after decrease of the viscosity by stirring followed by further stirring, respectively. In these Figures dotted line of the graphs indicates that the slurry was stood still without being stirred during the period of time covered by the lines.

In case of immediate addition of the stabilizer, as seen from FIG. 1, the viscosity increases due to addition and, though it decreases by subsequent stirring, decrease does not proceed beyond a certain limit. Also, the TAU value, as seen from FIG. 2, though once increases, decreases soon and no recovery is appreciated. To the contrary, in case of delayed addition of the stabilizer after decrease of viscosity of the slurry by stirring, the viscosity finally reaches to a lower level and the TAU value goes higher.

Production of slurry of SDA asphaltene according to the present invention enables production of a water slurry which has a low viscosity even at a high solid concentration and the fluidity of which can be kept stable for a long period of time in an industrial scale. It is possible to produce the slurry of SDA asphaltene-water mixture, which can be handled like CWM. Thus, the present invention contributes to complete transformation of petroleum resources into energy as a liquid fuel.

EXAMPLE 1

An SDA asphaltene produced in a petroleum refinery and having the properties shown in Table 2 below was charged in a ball mill-type grinder of capacity ten liters and ground.

TABLE 2

| | | | | |
|---|---|---|---|---|
| Shape of Material SDA Asphaltene: 30 mm × 30 mm × 2 mm | | | | |
| Calorific Value: | 9610 cal/g | | | |
| Softening Point: | 178° C., Ring & Ball Softening Point | | | |
| HGI: | 150 | | | |
| Composition (wt. %): | Carbon | 85.6 | Oxygen | 2.03 |
| | Hydrogen | 8.78 | Total Sulfur | 1.94 |
| | Nitrogen | 1.27 | Ash | 0.4 |

The stabilizing step was carried out by transferring the obtained slurry to another vessel provided with a stirrer (1600 rpm) and stirring. If the slurry is stood still without being stirred, then it loses fluidity and handling will be difficult.

Static stability of the produced slurry was evaluated by standing still the water slurry in test tubes and the ratio of heights of the resulting layers of supernatant liquid (W), soft packed slurry (SP) and hard packed slurry (HP).

Control Examples

The grinding step was conducted in the presence of dispersing agent or agents and without thickener, and then, stabilizing step by stirring only was carried out. The operating conditions and the results are shown in Table 3.

TABLE 3

| No. | Control 1 | Control 2 | Control 3 |
|---|---|---|---|
| (Grinding Step) | | | |
| Amount of Slurry (g) | 600 | 350 | 350 |
| Dispersing Agent | NSF | NSF + POE | POE |
| Addition (g/kg-Asphaltene) | 7 | 6 + 1 | 5 |
| (Stabilizing Step) | | | |
| Period of Stirring (min.) | 60 | 60 | 60 |
| (Product Water Slurry) | | | |
| Concentration (wt. %) | 69.0 | 66.8 | 68.4 |
| Viscosity (cps, 20° C.) | 1128 | 776 | 414 |
| (Stability) after | 2 days | 1 day | 1 day |
| W/SP/HP | 16.7*/83.3/00 | 00/68.9/31.1 | 5.4/48.6/46.0 |

*film formation at the surface observed
NSF = Naphthalene Sulfonic acid-Formalin condensation product
POE = Polyoxyethylene Octyl Ether Working Examples The grinding step was carried out in the presence of thickeners and also the stabilizing step, in the presence of stabilizer except for Run No. 5, in which no stabilizer was added in the stabilizing step. The operating conditions and the results are shown in Table 4.

TABLE 4

| | No. 1 | No. 2 | No. 3 | No. 4 | No. 5 |
|---|---|---|---|---|---|
| (Grinding Step) | | | | | |
| Amount of Slurry (g) | 350 | 600 | 350 | 600 | 600 |
| Dispersing Agent | NSF | NSF | POE | NSF | NSF |
| Addition (g/kg-SDA Asphaltene) | 7 | 7 | 4 | 7 | 7 |
| Thickener | CMC | CMC | CMC | HEC | CMC |
| Addition (ppm/slurry) | 300 | 300 | 350 | 150 | 300 |
| (Stabilizing Step) | | | | | |
| Stabilizer* | CMC | silica | silica | silica | — |
| Addition (ppm/slurry) | 300 | 1500 | 2000 | 1500 | — |
| Period of Stirring (min.) | 2 | 2 | 2 | 10 | — |
| (Product Water Slurry) | | | | | |
| Concentration (wt. %) | 68.7 | 69.5 | 68.4 | 69.1 | 68.6 |
| Viscosity (cps, 20° C.) | 994 | 1072 | 414 | 1065 | 960 |
| (Stability) days after | 23 | 20 | 19 | 23 | 23 |
| W/SP/HP | 6.8/88.1/5.1 | 00/100/0.0 | 1.4/92.6/6.4 | 00/99.5/0.5 | 6.8/84/9.3 |

*The stabilizer was added after stirring the slurry as done in the Control Examples
CMC = Carboxy Methyl Cellulose
HEC = Hydroxy Ethyl Cellulose From comparison of the date in Table 3 and Table 4 it is understood that the present invention remarkably improves stability of the product slurry. During the period for evaluation of the stability in all the working examples sedimented slurry was just soft packed slurry which was easy to repulpe. Even in Run No. 5, in which thickener was added only in the grinding step, stability was superior to those in Table 3, though somewhat inferior to the cases in which the stabilizer was added in the stabilizing step.

Particle size distribution of the slurries of Runs Nos. 1 to 3 was measured and the data are given in Table 5 below:

TABLE 5

| | No.1 | No. 2 | No. 3 |
|---|---|---|---|
| 10% pass, (μm) | 2 | 1.9 | 1.9 |
| 50% | 20.1 | 19.2 | 19.8 |
| 90% | 82.0 | 81.7 | 88.3 |
| 5.5 μm pass, (%) | 21.1 | 22.3 | 21.8 |
| MV* (μm) | 33.5 | 32.1 | 33.8 |

*Mean diameter of the Volume

EXAMPLE 2

The experiments below show the influence of temperature on the grinding operation, and the working examples illustrate the present method.

Experiments

The SDA asphaltene used in Example 1 was charged with water and dispersing agent in a 10-liter ball mill provided with warm water jackets, and ground. The balls used are made of SUS 304, and charged balls are: diameter 30 mm, 2.7 kg; 25 mm, 2.4 kg and 19 mm, 0.9 kg.

Grinding was carried out under the conditions shown in Table 6. The results are also shown in Table 6.

Run No. 1 was carried out at room temperature without taking any care of heating or cooling so that the temperature may vary under heat generation by rotation of the ball mill and heat release from the ball mill. As the results, the temperature of the product slurry was about 46° C. On the other hand, Runs Nos. 2 and 3 were carried out using warm water of 70° C. In Run No. 2 water evaporated in the process of grinding and caused increase of solid concentration to 71.1%, which resulted in formation of cake-like solid in the mill. In Run No. 3 water was supplemented in the amount equal to that lost by evaporation so as to prevent increase of slurry concentration, and thus it was possible to obtain product slurry the same as that in Run No. 1.

TABLE 6

| Experiments | No. 1 | No. 2 | No. 3 |
|---|---|---|---|
| Mill Temperature (° C.) | Room Temp | 70 | 70 |
| Temp. Controlling | no heating | warm water circulation | |
| (Charging Conditions) | | | |
| SDA Asphaltene (kg) | 0.42 | 0.42 | 0.42 |
| Dispersing Agent, NSF (g/kg-Asphaltene) | 7 | 7 | 7 |
| Thickener, CMC (ppm/slurry) | 300 | 300 | 300 |
| Water (kg) | 0.16 | 0.16 | 0.16 |
| (Grinding Conditions) | | | |
| Mill Rotation (rpm) | 60 | 60 | 60 |
| Grinding Period (min.) | 60 | 60 | 60 |
| Additional Water (kg) | — | — | 0.01 |
| (Properties of Slurry at Mill Outlet) | | | |
| Temperature (° C.) | 46 | 72 | 71 |
| Concentration (wt. %) | 68.9 | 71.1 | 68.2 |
| Viscosity (cps, 20° C.) | 2246 | 2320 | 1616 |

Working Example

Using the above DSA asphaltene as the material and a ball mill with cooling jackets, slurry production was carried out continuously under the conditions as shown in Table 7 below. Properties of the product slurry are also shown in Table 7.

TABLE 7

| | |
|---|---|
| (Material Charged) | |
| SDA Asphaltene: | 0.63 ton/Hr |
| Dispersing Agent: | NSF, 4.4 kg/Hr (supplied as a solution made by dissolving NSF in a portion of charged water) |
| Thickener: | CMC, 0.26 kg/Hr (the same as above) |
| Water: | 0.24 ton/Hr |
| (Conditions for Grinding) | |
| Mill Speed: | 17.5 rpm |
| Period: | 2.0 min |
| Input Grinding Energy: | $1.29 \times 10^4$ Kcal/ton-Slurry |
| (Propeties of Product Slurry) | |
| Temperature: | 48° C. |
| Viscosity: | 992 cps |
| Concentration: | 69.7 wt. % |

EXAMPLE 3

The SDA asphaltene the same as that used in EXAMPLE 1 was charged with water, a dispersing agent and a thickener in a ball mill of capacity 10-liters for grinding. Charging formulation and grinding conditions are as shown in Table 8.

The stabilizing step was conducted in a separate vessel for stirring (rotation 500 rpm).

TABLE 8

| | |
|---|---|
| SDA Asphaltene: | 0.415 kg |
| Dispersing Agent: | NSF, 7 g/kg-Asphaltene |
| Thickener: | CMC, 300 ppm (in Slurry) |
| Water: | 0.162 kg |
| Grinding: | Mill Speed 60 rpm, 60 min. |

Both the case of immediate addition of the stabilizer and the case of delayed addition of stabilizer after stirring for 45 min. were operated and compared. Attapulgus clay was used as the stabilizer at a concentration of 1500 ppm based on the slurry. Slurry concentrations, viscosities and yielding point (TAU values) at the outlet of the mill were measured, and after stirring for 20 hours, properties of the slurry were measured again. The results are shown in Table 9.

TABLE 9

| Addition of the Stabilizer | Immediate | Delayed |
|---|---|---|
| (Properties of Slurry at the Mill Outlet) | | |
| Slurry concentration (wt. %): | 69.5 | 68.9 |
| Viscosity (cps, 20° C.): | 2064 | 2085 |
| TAU value (mPa): | 0.37 | 0.60 |
| (Properties of Slurry after Addition of the Stabilizer) | | |
| Slurry Concentration (wt. %) | 69.3 | — |
| Viscosity (cps, 20° C.) | 2722 | — |
| TAU value (mPa) | 10.66 | — |
| (Stirring Conditions) | | |
| Speed (rpm) | 500 | 500 |
| Period of Time (min.) | 60 | 45 |
| (Properties of Slurry after Stirring) | | |
| Slurry Concentration (wt. %): | 69.1 | 68.8 |
| Viscosity (cps, 20° C.): | 2204 | 1182 |
| TAU value (mPa); | 0.98 | 0.24 |
| (Properties of Slurry after Addition of the Stabilizer) | | |
| Slurry Concentration (wt. %) | — | 69.1 |
| Viscosity (cps, 20° C.) | — | 1656 |
| TAU value (mPa) | — | 2.10 |
| (Properties of Slurry after 20 Hours) | | |
| Slurry Concentration (wt. %): | 69.4 | 69.1 |
| Viscosity (cps, 20° C.): | 1489 | 1156 |
| TAU value (mPa): | 0.87 | 3.10 |
| Status | gelled | still slurry |

EXAMPLE 4

EXAMPLE 3 was repeated with varied quantities of the Attapulgus clay used as the stabilizer. The operating conditions and the results are shown in Table 10.

TABLE 10

| | No. 1 | No. 2 | No. 3 | No. 4 |
|---|---|---|---|---|
| (Properties of Slurry after Stirring) | | | | |
| Slurry Concentration (wt. %) | 68.9 | 68.9 | 69.3 | 69.0 |
| Viscosity (cps, 20° C.) | 953 | 1035 | 1120 | 1095 |
| (Addition of Stabilizer) | | | | |
| Quantity (ppm/Slurry) | 500 | 1000 | 2000 | 3100 |
| Stirring Speed (rpm) | 500 | 500 | 500 | 500 |
| (Properties of Slurry after Addition of the Stabilizer) | | | | |
| Slurry Concentration (wt %) | 69.1 | 69.1 | 69.3 | 69.1 |
| Viscosity (cps, 20° C.) | 1012 | 1371 | 1435 | 2080 gelled |

Static stability and dynamic stability of the product slurry were evaluated. Evaluation of the static stability was done by standing still the slurry in test tubes and, after 24 hours, measuring the quantity of hard pack (height of the layer) formed by sedimentation of the SDA asphaltene.standing still as well as. The dynamic stability was evaluated by accumulative discharged amounts fractionated by the periods of time after applying oscillation to the slurry during 24 hours. The data are shown in Table 11.

TABLE 11

| | No. 1 | No. 2 | No. 3 | No. 4 |
|---|---|---|---|---|
| (Static Stability) | | | | |
| Hard Pack Formation (mm) | 1 | 0 | 0 | 0 |
| (Dynamic Stability) | | | | |
| Discharged Amount of Slurry after Applying Oscillation | | | | |
| within 10 seconds (g) | 143.2 | 152.6 | 131.5 | 123.0 |
| 10 seconds–5 minutes (g) | 12.9 | 13.7 | 14.6 | 7.6 |
| 5 minutes–6 minutes (g) | 8.5 | — | 21.1 | 24.1* |
| remaining after 6 minutes (g) | 5.9 | 18.3 | 10.9 | 20.3* |
| | | | | * gelled |
| (Dynamic Stability) | | | | |
| Slurry Concentration after Applying Oscillation | | | | |
| Discharged within 10 sec. (wt. %) | 68.9 | 68.5 | 69.5 | 69.0 |
| Discharged 10 sec.–5 min. (wt. %) | 74.9 | 70.6 | 69.6 | 69.3 |
| Discharged 5 min.–6 min. (wt. %) | 74.4 | — | 71.4 | 71.5 |
| Remaining after 6 min. (wt. %) | 75.6 | 74.9 | 71.3 | 71.8 |
| Average (wt. %) | 69.8 | 69.3 | 69.9 | 69.6 |
| (Slurry Sedimentation) | | | | |
| Rate of Sedimentation (%/Hr) | 0.112 | 0.088 | 0.046 | 0.066 |

From comparison of Runs. Nos. 1–4, it is concluded that the quantity of the Attapulgus clay used as the stabilizer has a suitable range. In general, suitable amount of the stabilizer may vary depending on many factors such as kind of the material SDA asphaltene, targeted water slurry concentration, kinds of the dispersing agents, and the kinds and amounts of the thickener used in the grinding step.

We claim:

1. A method of producing a water slurry of SDA asphaltene having high stability at a high solid concentration, comprising: a grinding step of grinding the SDA residue with water in the presence of a dispersing agent; and a stabilizing step of stirring the resulting slurry to stabilize it, the stabilizing step being carried out with addition of a stabilizer, which is added after a decrease of viscosity of the slurry to 1500 cps or less produced by said stirring.

2. A method of producing a water slurry of SDA asphaltene according to claim 1, wherein the stabilizer used is one or more of the substances chosen from the following groups:

a) carboxymethyl cellulose, hydroxyethyl cellulose, xanthan gum, gua gum, starch, polyvinyl alcohol, polyethylene glycol and polyethylene oxide; and b) magnesium hydroxide, magnesium oxide, colloidal silica, kaolin, bentonite and Attapulgus clay.

3. A method of producing a water slurry of SDA asphaltene according to claim 1, wherein the stabilizer is used in an amount of 20–3000 ppm on the basis of the slurry.

4. A method of producing a water slurry of SDA asphaltene having high stability at a high solid concentration, comprising: a grinding step of grinding the SDA asphaltene with water in the presence of a dispersing agent, and a stabilizing step of stirring the resulting slurry to stabilize it; the grinding step being carried out with addition of a thickener as a viscosity increasing agent, and the stabilizing step being carried out with addition of a stabilizer, said stabilizer being added after a decrease of viscosity of the slurry to 1500 cps or less produced by said stirring.

5. A method of producing a water slurry of SDA asphaltene according to claim 4, wherein the thickener used is one or more of the substances chosen from the following groups:

1) carboxymethyl cellulose, hydroxyethyl cellulose, xanthan gum, gua gum, starch, polyvinyl alcohol, polyethylene glycol and polyethylene oxide;

2) sodium hydroxide and potassium hydroxide; and 3) magnesium hydroxide, magnesium oxide, colloidal silica, kaoline, bentonite and Attapulgus clay;

and the stabilizer used is one or more of the substances chosen from the following groups:

a) carboxymethyl cellulose, hydroxyethyl cellulose, xanthan gum, gua gum, starch, polyvinyl alcohol, polyethylene glycol and polyethylene oxide; and b) magnesium hydroxide, magnesium oxide, colloidal silica, kaolin, bentonite and Attapulgus clay.

6. A method of producing a water slurry of SDA asphaltene according to claim 4, wherein the stabilizer is used in an amount of 20–3000 ppm on the basis of the slurry.

7. A method of producing a water slurry of SDA asphaltene according to claim 4, wherein a ratio of the thickener added in the grinding step and the stabilizer added in the stabilizing step is so chosen to be in the range of, by weight, 1:7–2:1.

8. A method of producing a water slurry of SDA asphaltene according to claim 4, wherein the thickener is used in an amount of 20–3000 ppm, on the basis of the slurry.

9. A method of producing a water slurry of SDA asphaltene according to claim 1 or 4, wherein the grinding step is carried out with a slurry concentration of 67–71 wt. % and a temperature of 80° C. or lower.

10. A method of producing a water slurry of SDA asphaltene according to claim 1 or 4, wherein the grinding step is carried out with addition of water of a quantity which is a sum of a quantity necessary for achieving the targeted slurry concentration and a quantity assumed to be lost by evaporation.

* * * * *